US009978192B1

(12) United States Patent
Nicosia et al.

(10) Patent No.: US 9,978,192 B1
(45) Date of Patent: May 22, 2018

(54) METHOD AND APPARATUS FOR STREAMLINING GUEST ENTRY INTO A BUILDING

(71) Applicants: Matthew Coggins Nicosia, Philadelphia, PA (US); Andrew Otto, Hoboken, NJ (US)

(72) Inventors: Matthew Coggins Nicosia, Philadelphia, PA (US); Andrew Otto, Hoboken, NJ (US)

(73) Assignee: Guestof, LLC, Philadelphia, PA (US)

( * ) Notice: Subject to any disclaimer, the term of this patent is extended or adjusted under 35 U.S.C. 154(b) by 0 days. days.

(21) Appl. No.: 15/646,565

(22) Filed: Jul. 11, 2017

Related U.S. Application Data

(60) Provisional application No. 62/362,261, filed on Jul. 14, 2016.

(51) Int. Cl.
*G07C 9/00* (2006.01)

(52) U.S. Cl.
CPC ..... *G07C 9/00023* (2013.01); *G07C 9/00103* (2013.01); *G07C 9/00119* (2013.01); *G07C 9/00571* (2013.01); *G07C 9/00817* (2013.01); *G07C 9/00857* (2013.01); *G07C 9/00904* (2013.01); *G07C 2009/00246* (2013.01); *G07C 2009/00769* (2013.01); *G07C 2009/00825* (2013.01); *G07C 2009/00865* (2013.01)

(58) Field of Classification Search
CPC ..... G07C 9/00023; G07C 9/00103; G07C 9/00119
USPC ..... 340/5.6–5.65
See application file for complete search history.

(56) References Cited

U.S. PATENT DOCUMENTS 7,352,867 B2 * 4/2008 Medvinsky ..... H04L 9/083 380/278
7,353,388 B1 * 4/2008 Gilman ..... H04L 63/06 713/168
7,634,645 B2 * 12/2009 Zhang ..... G06F 21/121 713/1
8,844,811 B1 9/2014 Rogers et al.
2002/0152395 A1 * 10/2002 Zhang ..... G06F 21/10 726/26
2005/0132201 A1 * 6/2005 Pitman ..... G06F 21/645 713/176
2007/0176739 A1 * 8/2007 Raheman ..... G07C 9/00904 340/5.64
2007/0244811 A1 * 10/2007 Tumminaro ..... G06Q 20/10 705/39
2012/0066515 A1 * 3/2012 Kasuya ..... H04L 9/3242 713/189

(Continued)

OTHER PUBLICATIONS www.jeremyblum.com/portfolio/libetech/ 5 pages.

*Primary Examiner* — Allen T Cao
(74) *Attorney, Agent, or Firm* — Joseph E. Maenner; Maenner & Associates, LLC

(57) ABSTRACT

A method of providing an electronically generated key includes the steps of generating an account for a resident; allowing the resident to access a software application; receiving a request from the resident for an electronic pass; and generating the electronic pass. The method further includes the steps of electronically detecting the electronic pass at a reader; determining whether the electronic pass is valid; and activating a relay if the electronic pass is valid. A device for receiving the request and for activating the relay is also provided.

17 Claims, 13 Drawing Sheets

(56) References Cited

U.S. PATENT DOCUMENTS

| | | | | |
|---|---|---|---|---|
| 2013/0257590 | A1 | 10/2013 | Kuenzi et al. | |
| 2015/0199863 | A1* | 7/2015 | Scoggins | G07C 9/00904 340/5.25 |
| 2016/0005248 | A1* | 1/2016 | Aase | G06F 21/34 340/5.61 |
| 2017/0287248 | A1* | 10/2017 | Aase | G07C 9/00857 |

* cited by examiner

METHOD AND APPARATUS FOR STREAMLINING GUEST ENTRY INTO A BUILDING

CROSS-REFERENCE TO RELATED APPLICATION

The present application claims priority from U.S. Provisional Patent Application Ser. No. 62/362,261, filed on Jul. 14, 2016, which is incorporated herein by reference in its entirety.

BACKGROUND OF THE INVENTION

Field of the Invention

The present invention relates to a system and method for providing an electronically generated key to allow a party to have temporary access to a locked location.

Description of the Related Art

Often, a resident of a building requires a third party to access their location while the resident is unavailable. A common method to provide access to the location is for the resident to leave a key "under the mat". This method, however, is not secure.

It would be beneficial to provide a system end method for the resident to allow the third party to access the location that is more secure and simpler than prior methods.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one embodiment, the present invention is a method of providing an electronically generated key. The method includes the steps of generating an account for a resident; allowing the resident to access a software application; receiving a request from the resident for an electronic pass; and generating the electronic pass. The method further includes the steps of electronically detecting the electronic pass at a reader; determining whether the electronic pass is valid; and activating a relay if the electronic pass is valid.

The present invention also provides a device for receiving the request and for activating the relay.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION

Figure 1:
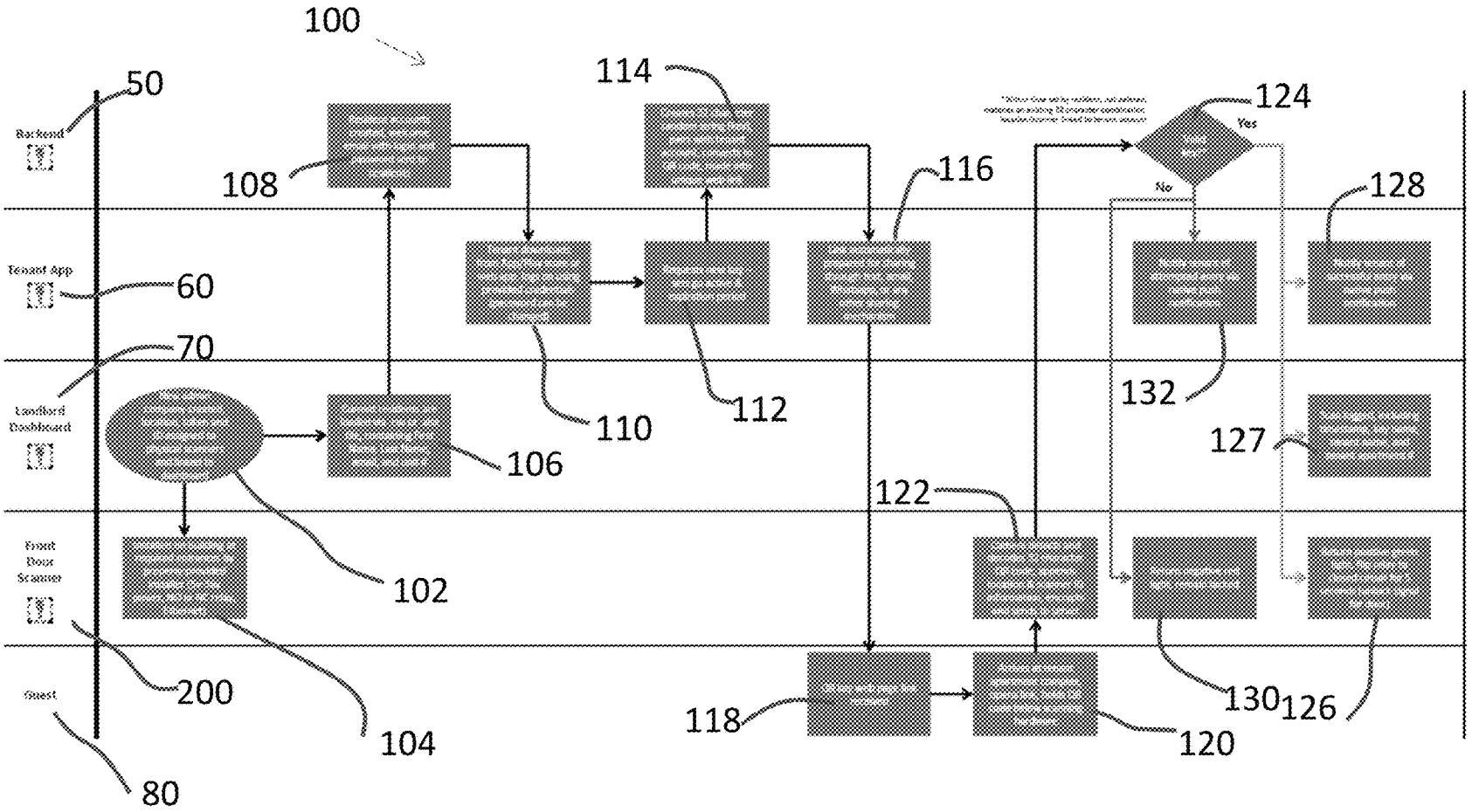
FIG. 1 is a flowchart showing an exemplary method according to the present invention.

In the drawings, like numerals indicate like elements throughout. Certain terminology is used herein for convenience only and is not to be taken as a limitation on the present invention. The terminology includes the words specifically mentioned, derivatives thereof and words of similar import. As used herein, the term "resident" is defined as a tenant of a physical location, such as an apartment, an office, or other secure space. A "third party" is a person or persons to whom the resident desires to temporarily allow access the physical location.

The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary"

is not necessarily to be construed as preferred or advantageous over other aspects or designs. Rather, use of the word exemplary is intended to present concepts in a concrete fashion.

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Unless explicitly stated otherwise, each numerical value and range should be interpreted as being approximate as if the word "about" or "approximately" preceded the value of the value or range.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the present invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

Referring to the flowchart in FIG. 1, a system 100 that operates an exemplary method of providing an electronic key to allow temporary access of a location to a third party is provided. FIG. 1 shows a system Backend 50, on which operating software for system 100 resides; a Tenant App 60, that is used by a resident to interface with Backend 50 and to permit access to a third party; a Landlord Dashboard 70, that provides a landlord of the location with information about system 100; a Front Door Scanner, or electronic reader 200, that is used by a Guest 80, or a third party, to access the location.

Figure 1A:
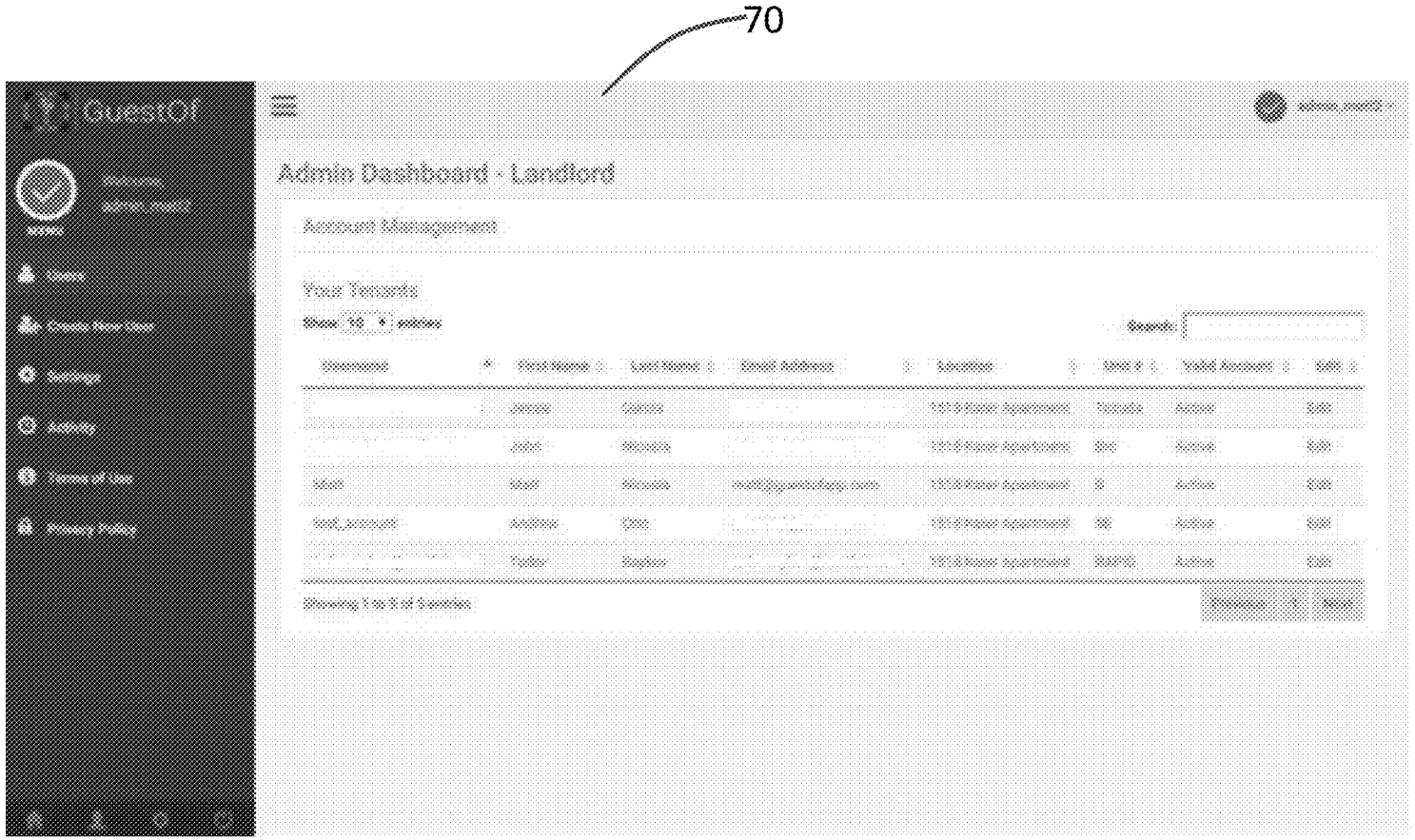
FIG. 1A is an exemplary GUI of a listing of users on an Administrator dashboard used with the present invention.
Figure 1B:
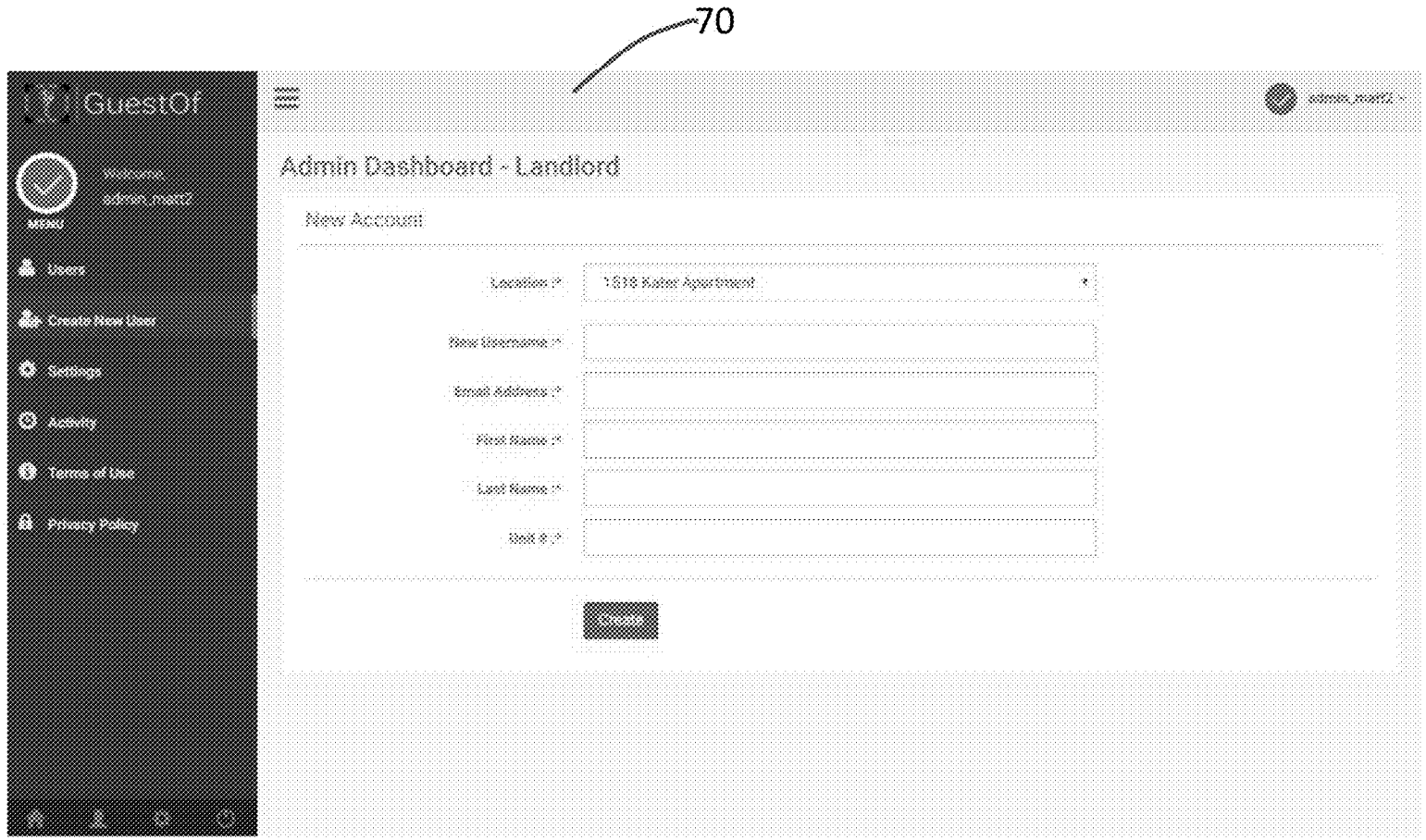
FIG. 1B is an exemplary GUI of a new account generation screen on the Administrator dashboard.
Figure 1C:
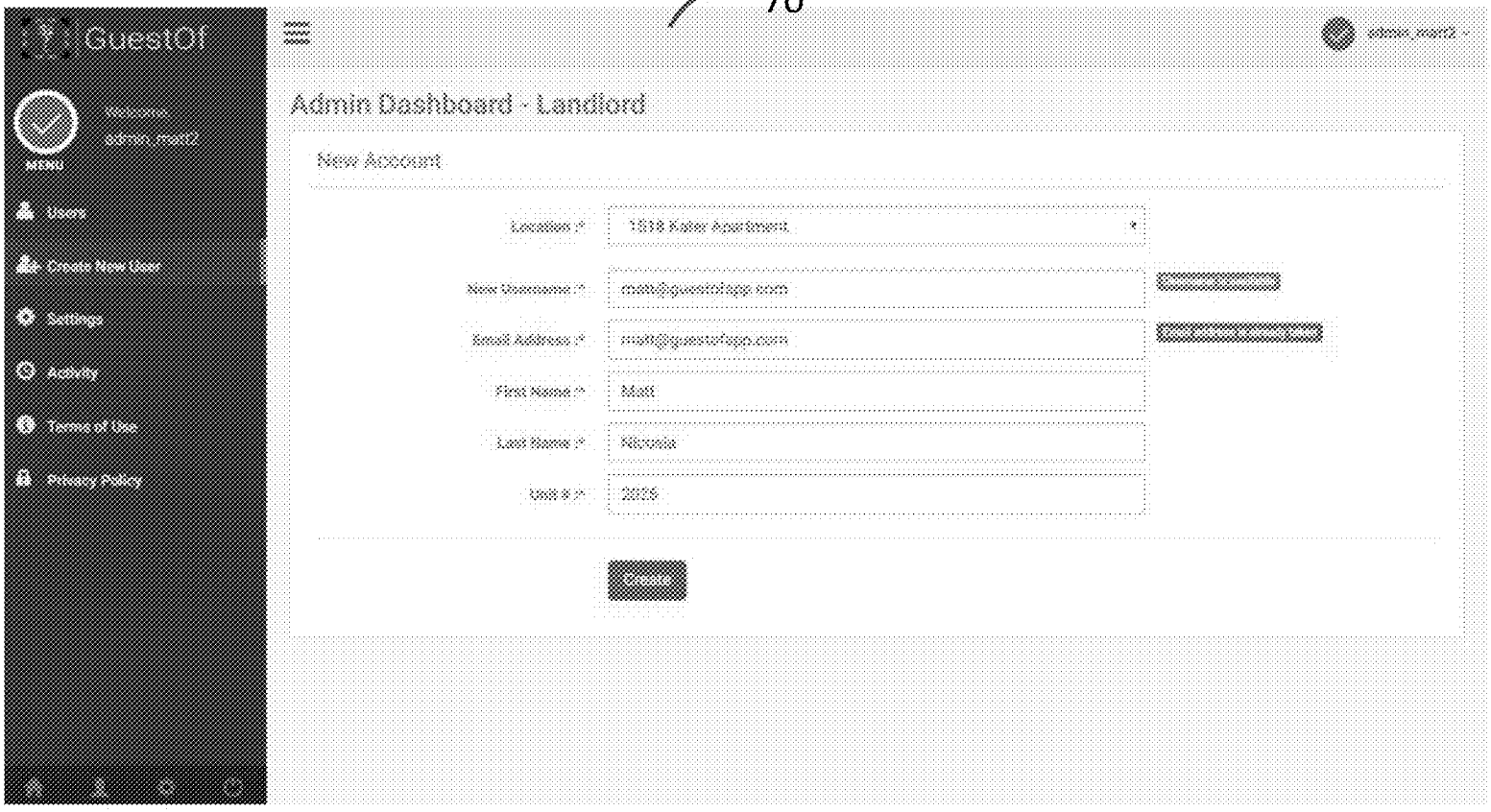
FIG. 1C is an exemplary GUI of the new account generation screen of FIG. 1B, with a resident account information input onto the screen.
Figure 1D:
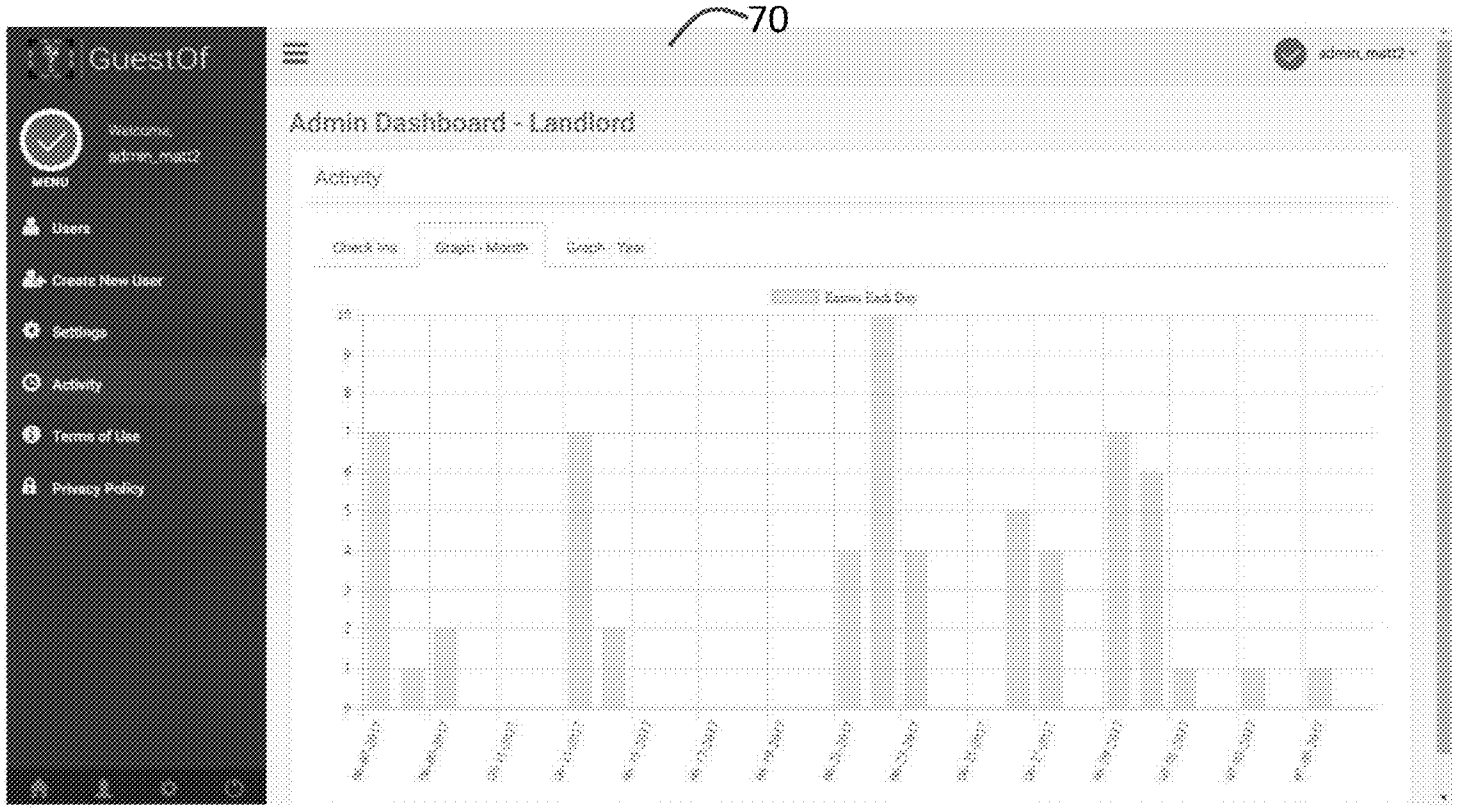
FIG. 1D is an exemplary GUI of an activity screen showing resident activity in graphical format on the Administrator dashboard.
Figure 1E:
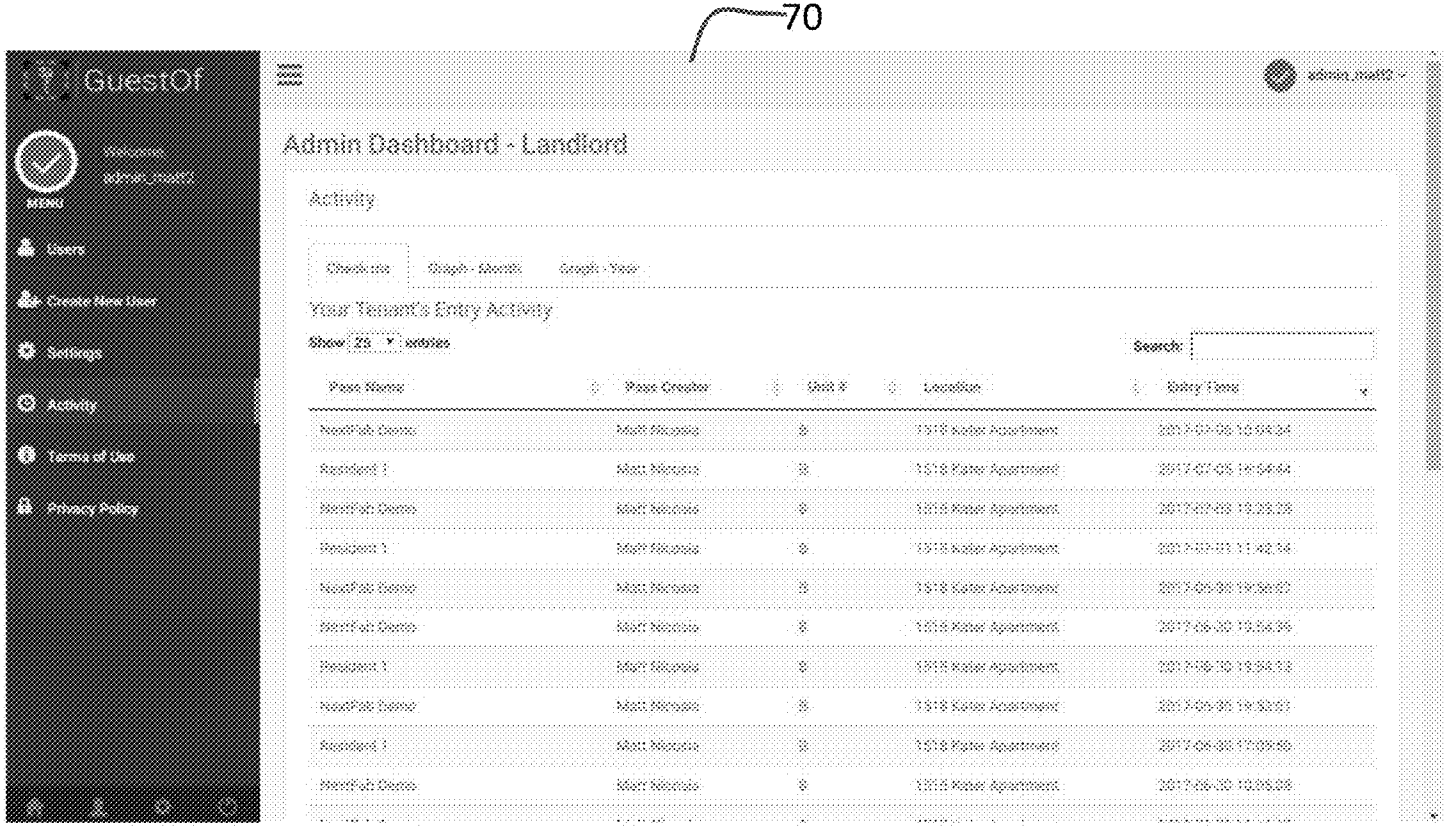
FIG. 1E is an exemplary GUI of an activity screen showing activity at a resident's location on the Administrator dashboard.

Exemplary GUI of Landlord Dashboard 70 are shown in FIGS. 1A-1E. FIG. 1A shows a GUI of the users of system 100. FIGS. 1B and 1C show GUIs for generating a new resident account. FIG. 1D shows a GUI for the activity of system 100 over a time period. FIG. 1E shows a GUI for activity for a particular location over a time period.

The temporary access can be to permit non-resident third party 80 access to the location such as, for example, a cleaning service, a dog walker or pet sitter, a delivery person, or some other person who the resident desires to provide access to the location for a temporary amount of time.

Figure 2:
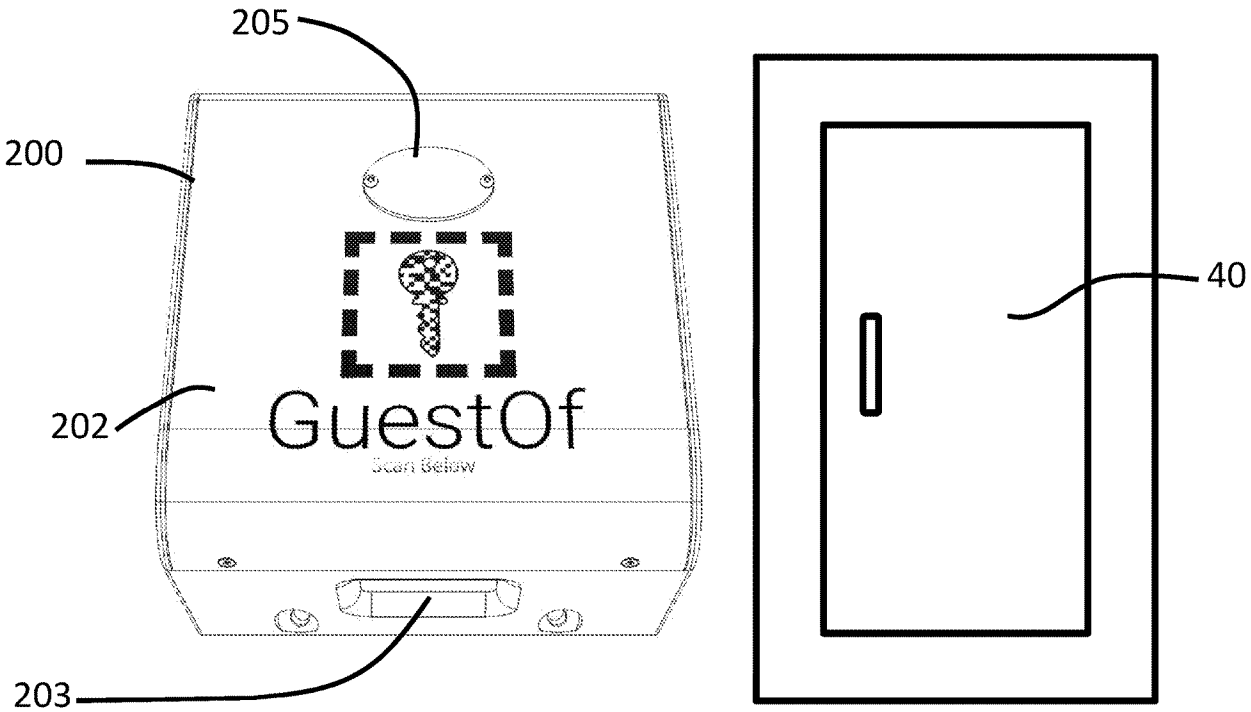
FIG. 2 is a front elevational view of an electronic reader for use with the method shown in FIG. 1.
Figure 3:
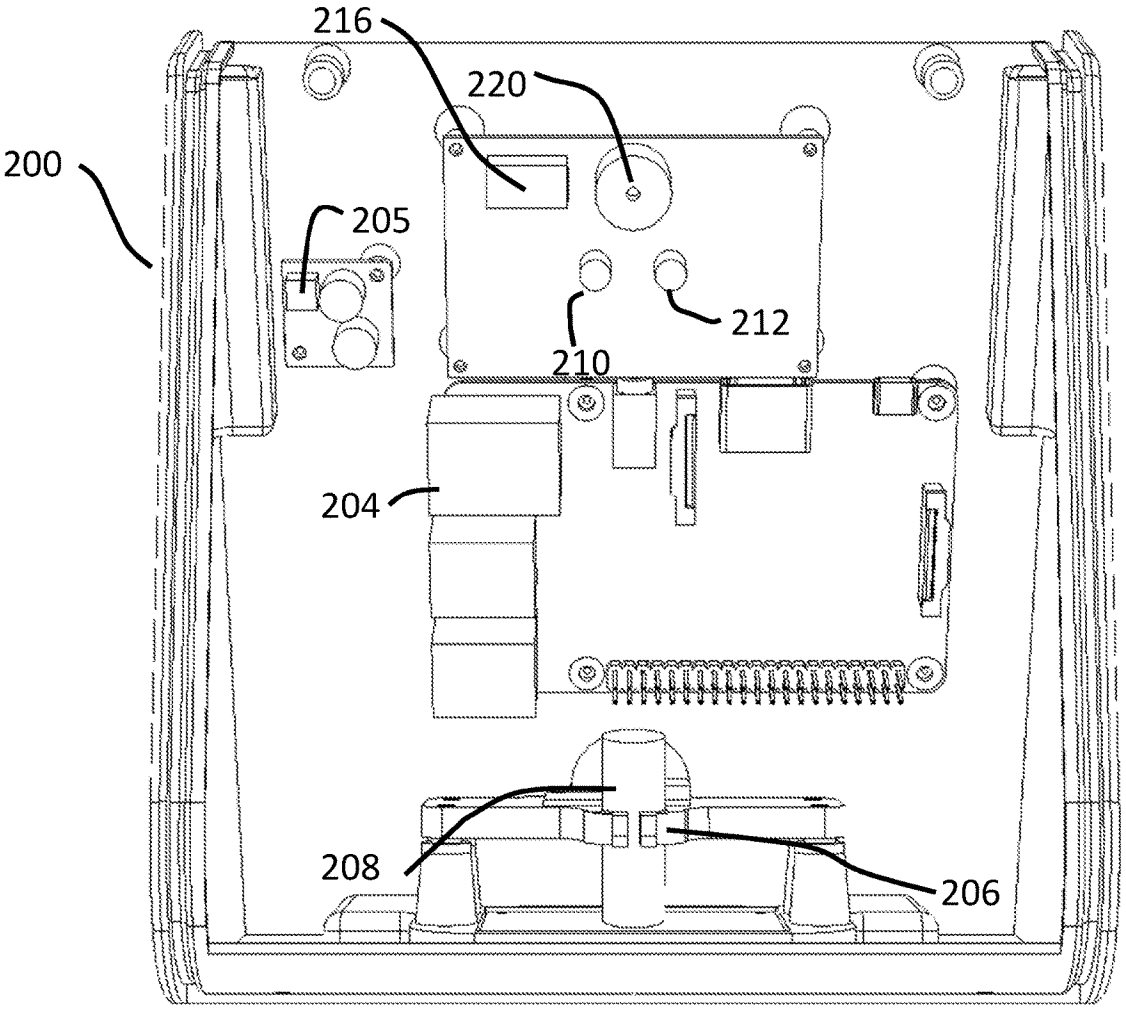
FIG. 3 is a front elevational view of the reader shown in FIG. 2, with the front cover of the reader removed.

Electronic reader 200, shown in FIGS. 2 and 3, is provided at the location, such as a door 40, to read the electronic key and to transmit a signal to unlock access to the location. Reader 200 includes a housing 202 that contains operating components. The components include a processor 204 that is used to process all electronic signals associated with reader 200. Reader 200 can be electrically connected to previously existing electrical supply at the location, and a voltage converter 205 can be provided to convert supplied electrical voltage to a voltage sufficient for processor 204.

A camera 206 is located inside reader 200 to be able to read an electronically generated picture, such as a QR code or other similarly generated image. A laser 208 is provided to give an indication to a user where to place the QR code for camera 206 to read the QR code. A transparent or translucent panel 203 is provided on housing 202 to allow camera 206 to view a displayed QR code and to allow laser 208 to identify the location where to place the QR code for camera 206 to read.

LED lights 210, 212 are provided to give visual indication of the status of a relay 216 that is used to lock/unlock a door 40 (shown in FIG. 2) that is operatively connected to relay 216. By way of example only, lights 210, 212 are RGB LED lights that can be green to indicate that access has been granted, and alternatively can be red to indicate that access has been denied. A transparent or translucent panel 205 is provided on housing 202 to allow lights 210, 212 to shine through panel 205 in order to allow third party 80 to visualize whether relay 216 has or has not activated. An audible buzzer 220 can be included to provide an audible indication that camera 206 has detected a QR code.

Referring back to FIG. 1, in step 102, reader 200 is identified with a randomized token and identification number and linked to a specific administrator account. In step 104, a location at which reader 200 is to be mounted is selected and reader 200 is installed. Typically, the location is proximate to lockable door 40. System 100 is operated to unlock door 40 to allow temporary access to the location. The location can have a separate reader 200 at each of a single or multiple doors 40 throughout the location.

In step 106, data regarding current residents at the location are input from a data file into software at the administrator dashboard that is associated with reader 200 and runs the method. The data can include, but is not limited to, the resident's name, email and unit (apartment, office, etc.) number within the location. In step 108, an account for each resident is created at Backend 50 and stored permanently in a database. An e-mail is sent to each resident's e-mail address with login and password information for that resident.

In step 110, each resident downloads software (Tenant App 60) from Backend 50 using the login and password information. The software can be a cellphone app, a web app, or other software provided to operate the method. The software allows the resident to electronically generate a "key" for a third party 80 to access the resident's location.

Figure 5:
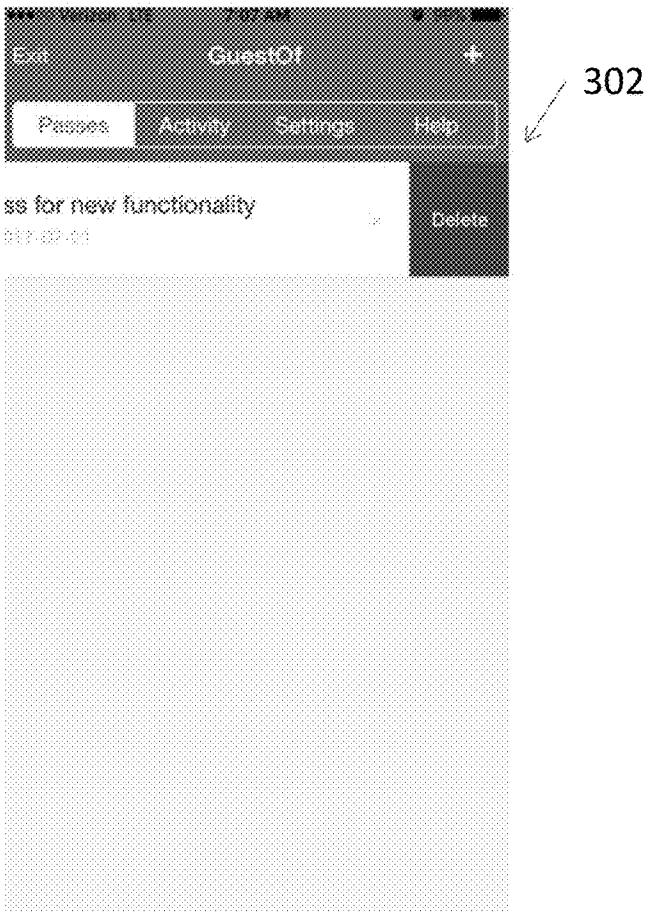
FIG. 5 is an exemplary GUI of the page of FIG. 4, with a pass prepared for deletion.
Figure 4:
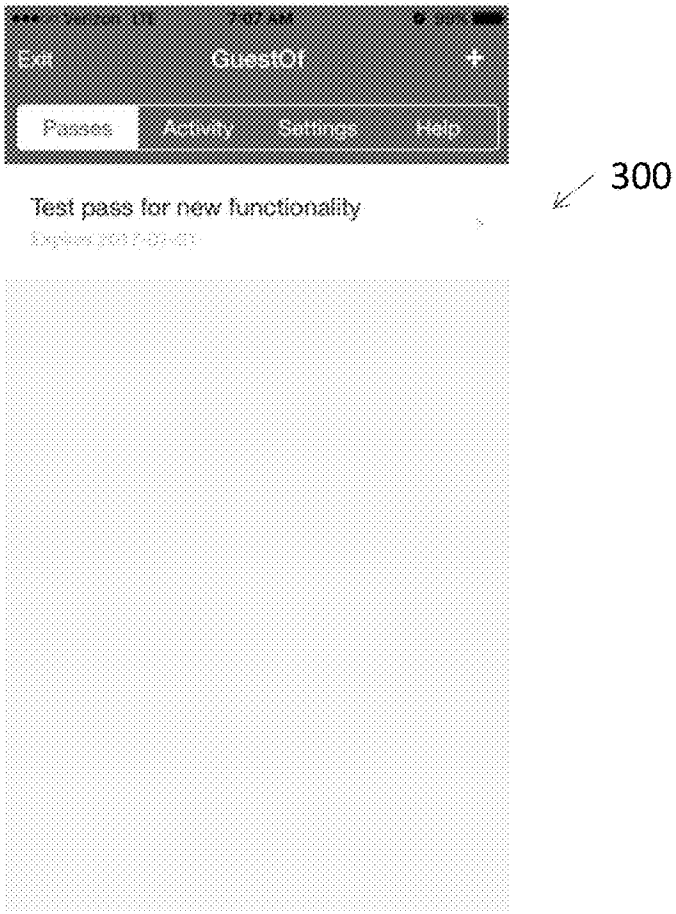
FIG. 4 is an exemplary Graphical User Interface ("GUI") of a screen shot of a "Passes" page of a cell phone app to use the method of FIG. 1.
Figure 7:
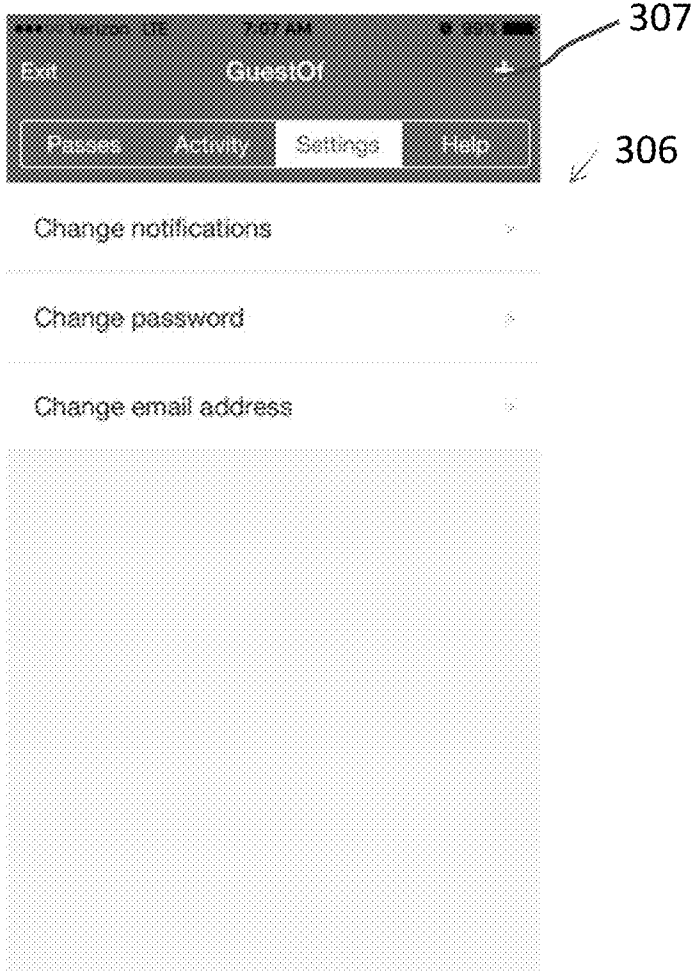
FIG. 7 is an exemplary GUI of a "Settings" page of the cell phone app.
Figure 6:
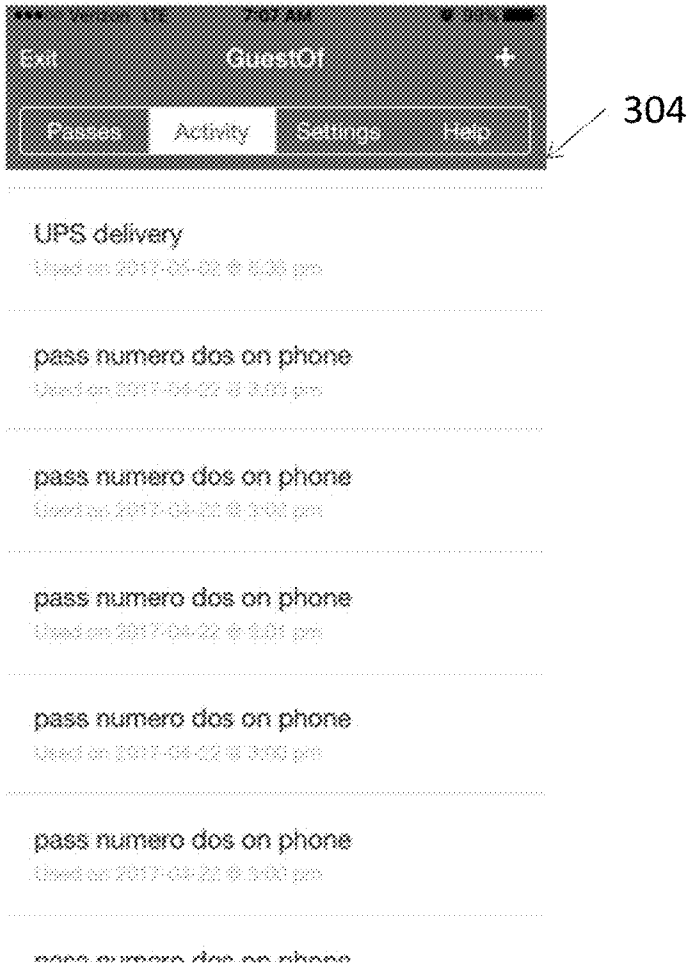
FIG. 6 is an exemplary GUI of a listing of activity using a resident's electronic keys on an "Activity" page of the cell phone app.
Figure 9:
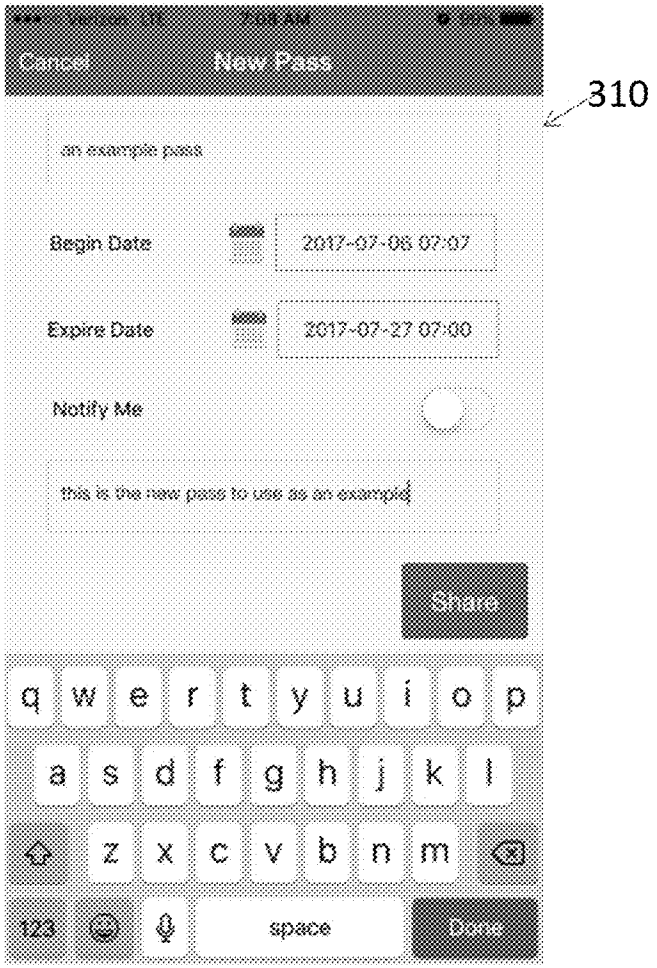
FIG. 9 is an exemplary GUI of the page of FIG. 8, with all fields filled out.
Figure 8:
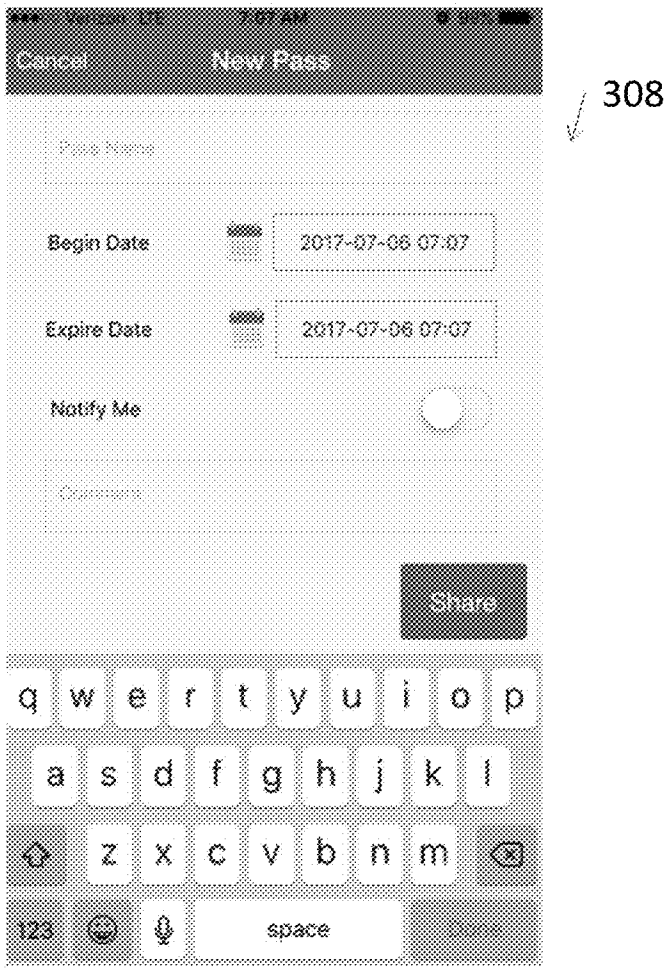
FIG. 8 is an exemplary GUI of a New Pass generation page of the cell phone app.
Figure 11:
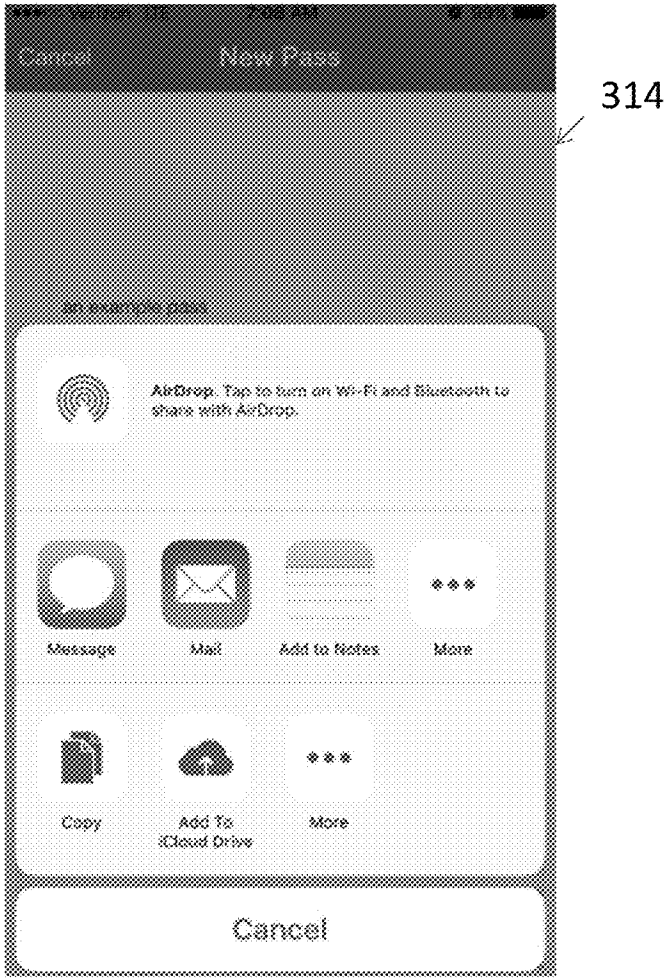
FIG. 11 is an exemplary GUI showing a method of sharing the key generated in FIGS. 8-10.

FIGS. 4-13 show exemplary GUIS screen shot 300-318 of system 100 when the resident wants to generate a temporary key. Screen 300, shown in FIG. 4, shows a "Passes" screen that lists all of a resident's pending passes for third parties. Screen 302 in FIG. 5 shows a pass from FIG. 4 ready for deletion. Screen 304 in FIG. 6 provides an overview of Activity for a resident and screen 306 in FIG. 7 shows different Settings that the resident can modify.

In step 112, when the resident wants to generate a temporary key for a third party 80 to access the resident's location, the resident uses the Tenant App 60 to generate a new electronic key and set a timeframe or a duration that the key is active. Resident generates a new electronic key by pressing the "+" button 307, shown in FIG. 7, which generated screen 308, shown in FIG. 8. For example, as shown on screen 308, if a cleaning service typically accesses the location on a specific day and during specific hours, the timeframe can be set for that day and within those hours. A comment can also be input by the resident if desired, as shown on screen 310 in FIG. 9. Alternatively, if a delivery is estimated to be within a span of multiple days, the key can be generated to be active only during those days.

Optionally, the key can be activated to only work once; that is, once reader 200 reads the key and unlocks access to the location, the key is permanently disabled. Alternatively, the key can be programmed to work multiple times throughout the timeframe. This feature can be applicable to a dog walker, who must gain access to the location to get the dog to be walked and then, after the dog has been walked, gain access to the location again to return the dog. In such an instance, the key can be generated to work only two times during the designated timeframe.

Figure 10:
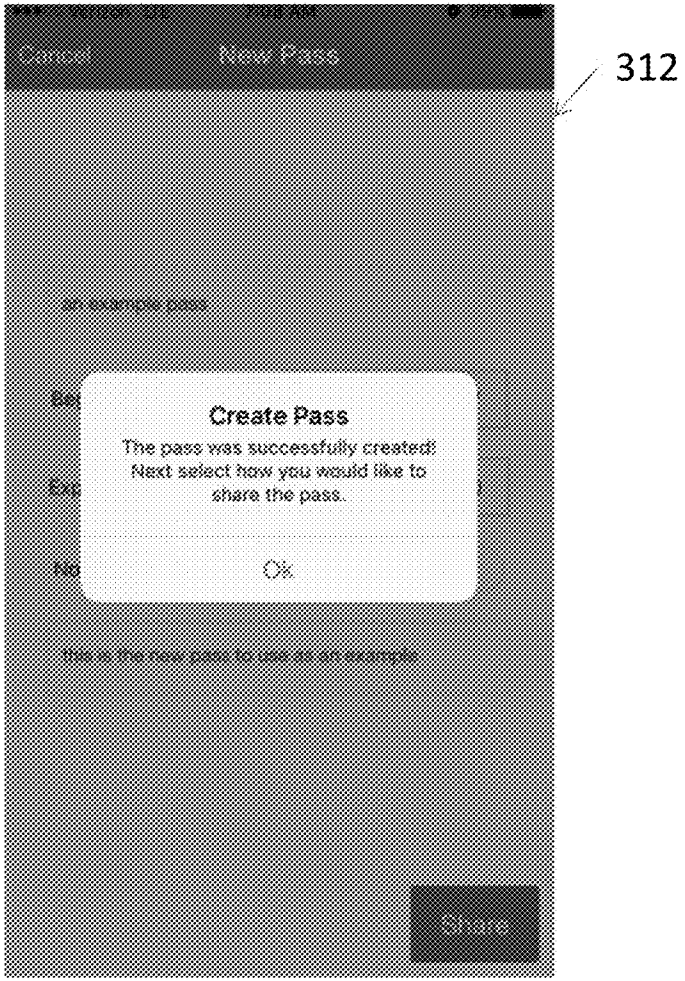
FIG. 10 is an exemplary GUI confirming the successful creation of a new electronic key.

In step 114, Backend 50 generates an electronic pass or key for third party 80 to use (shown on screen 312 in FIG. 10). Screen 312 in FIG. 10 confirms the generation of the key. The key can be a 32 character random string that pairs with the resident data loaded into system 100 in step 106, such as the location that is desired to be accessed. In an exemplary embodiment, the string is converted into a Quick Response (QR) code. The QR code is then made into a unique web link and provided to the resident on Tenant App 60. The link is provided to the resident in step 116 for sharing via text, e-mail, Whatsapp, or other electronic data sharing mechanism as shown on screen 314 in FIG. 11. The key at the link becomes an electronic pass for third party 80. Additionally, comments that instruct third party 80 on how to use the pass or general background info are provided in the web link if so desired.

Figure 13:
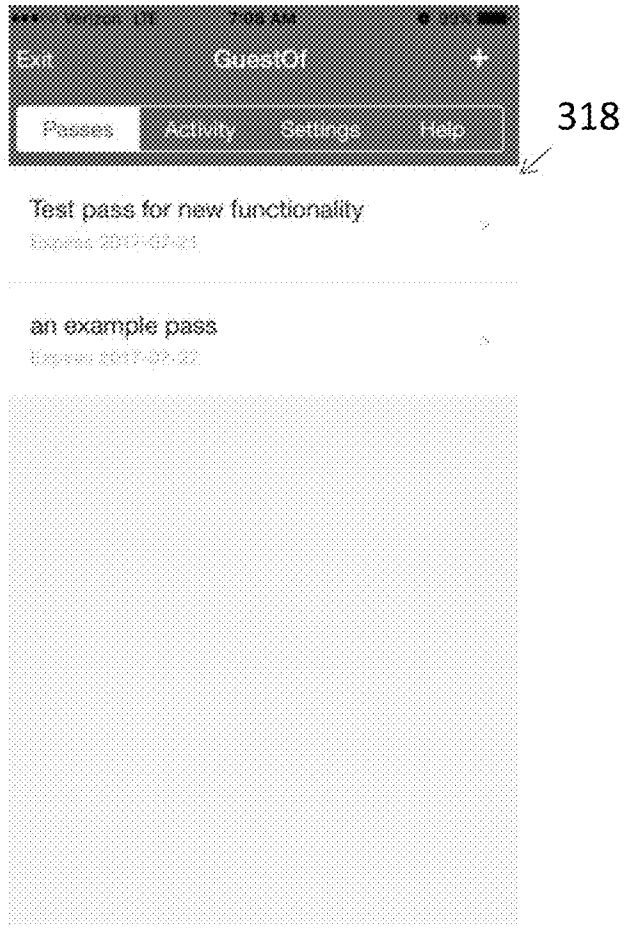
FIG. 13 is an exemplary GUI showing the existence of the key generated in FIGS. 8-11, added to the screen of FIG. 4.
Figure 12:
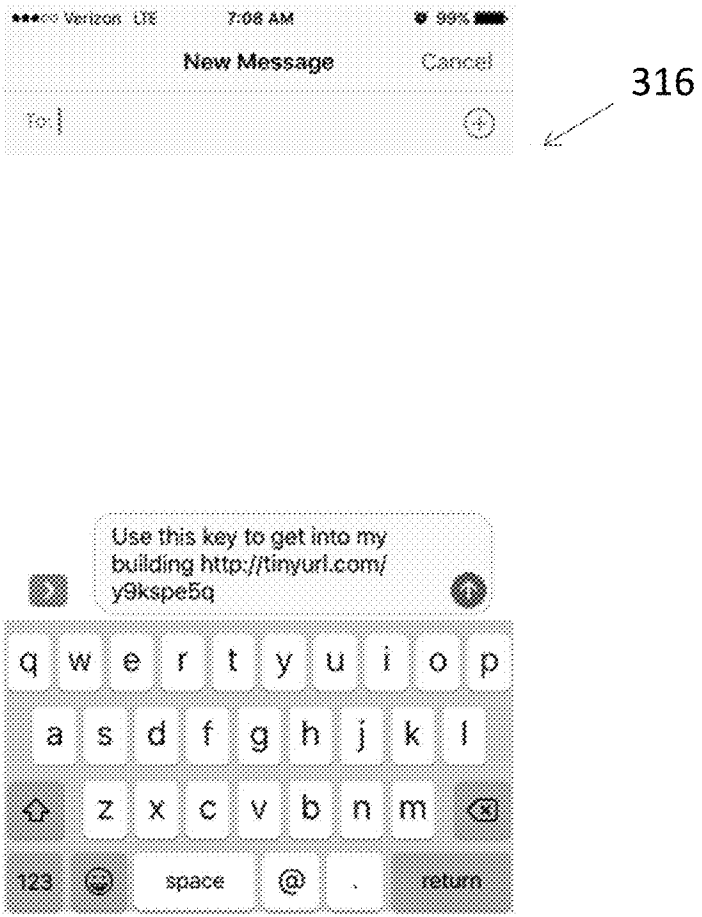
FIG. 12 is an exemplary GUI of a message sent to a third party to access the electronic key.

In step 118, the resident shares the link with third party 80 as described above with respect to step 116, as shown on screen 316 in FIG. 12. Screen 318 in FIG. 13 shows the electronic key on resident's app, along with the expiration date of the key. In step 120, when third party 80 arrives at the location, third party 80 displays the QR code to reader 200. In step 122, reader 200 performs the following steps: electronically detects the QR code (electronic pass) at reader 200; confirms receipt of key by a visual indication of lights 210, 212, which are illuminated yellow, and/or an audio indication by buzzer 220; decodes the QR code; appends locally stored information about reader 200, such as the location and ID information for reader 200; and transmits an electronic message to Backend 50.

In step 124, Backend 50 compares the information presented by third party 80 with the previously generated key information in step 114 to determine whether the QR code presented by third party 80 is valid. If the QR code is valid, in step 126, Backend 50 transmits an electronic signal to reader 200 to provide an indication to third party 80 that the QR code has been accepted. The indication can be a visual indication, such as green lights 210, 212. Additionally, Backend 50 transmits an electronic signal to reader 200 to activate relay 216, which unlocks door 40 to allow third party 80 to enter the location. Relay 216 is activated for a predetermined period of time such as, for example, about 5 seconds, to allow third party 80 to open door 40.

In step 127, information regarding third party 80 accessing the location is electronically transmitted to Landlord Dashboard 70. Such information can be a timestamp, identifying the time when third party 80 accessed the location, the name of the resident who generated the electronic key, along with the resident's space number inside the location. Further, the key name is also be provided.

In step 128, Backend 50 also transmits an electronic message to the resident via Tenant App 60 to notify the resident of a successful access of the location by third party 80.

If, however, in step 124, Backend 50 does not recognize the QR code as being valid, in step 130, reader 200 provides a visual indication, such as red lights 210, 212, to inform third party 80 that access has not been granted. Relay 216 remains inactive and door 40 is not unlocked. Additionally, in step 132, an electronic message is transmitted to the resident via Tenant App 60 to inform the resident that third party 80 attempted to access the residence, but that admission to third party 80 was denied to third party 80.

It will be further understood that various changes in the details, materials, and arrangements of the parts which have been described and illustrated in order to explain the nature of this invention may be made by those skilled in the art without departing from the scope of the invention as expressed in the following claims.

We claim:

1. A method of providing an electronically generated pass, the method comprising the steps of:

(a) generating an account for a resident;

(b) allowing the resident to access a software application;

(c) receiving a request from the resident for an electronic pass;

(d) generating the electronic pass;

(e) electronically detecting the electronic pass at a reader;

(f) determining whether the electronic pass is valid; and (g) activating a relay if the electronic pass is valid.

2. The method according to claim 1, wherein the method comprises, prior to step (a), installing the reader proximate to a lockable entrance.

3. The method according to claim 1, wherein step (a) comprises associating the resident with a location.

4. The method according to claim 3, wherein the lockable entrance is at the location and wherein step (g) further comprises unlocking the lockable entrance.

5. The method according to claim 3, wherein step (d) comprises generating a code and transmitting the code to the resident.

6. The method according to claim 5, wherein step (f) comprises determining whether the code is valid.

7. The method according to claim 6, wherein step (g) comprises activating the relay at the location.

8. The method according to claim 1, further comprising the step of:

(h) deactivating the relay after a predetermined period of time.

9. The method according to claim 1, further comprising the step of:

(h) notifying the resident that the relay has been activated.

10. The method according to claim 1, further comprising the step of notifying the resident of the performance of step (e) and not activating the relay.

11. A method of providing an electronically generated pass, the method comprising the steps of:

(a) generating an account for a resident;

(b) allowing the resident to access a software application;

(c) receiving a request from the resident for an electronic pass; and (d) generating the electronic pass;

wherein step (d) comprises transmitting the electronic pass to a third party.

12. A method of allowing a third party to access to a locked space comprising the steps of:

(a) generating an account for a resident of the locked space;

(b) receiving a request from the resident to generate a temporary electronic key to allow the third party to access the space;

(c) generating a temporary code;

(d) storing the temporary code at a location accessible to the third party;

(e) reading the temporary code when presented by the third party; and (f) unlocking the locked space for the third party.

13. The method according to claim 12, wherein step (c) comprises generating an electronic code.

14. The method according to claim 13, wherein step (b) comprises receiving a time duration of the temporary code from the resident.

15. The method according to claim 12, wherein step (e) comprises capturing an image of the temporary code at a reader.

16. The method according to claim 12, further comprising the step of:

(g) notifying the resident that locked space was unlocked for the third party.

17. The method according to claim 12, further comprising the step of:

(g) re-locking the locked space after a predetermined period of time.

* * * * *